US009955796B2

(12) United States Patent
Schulte et al.

(10) Patent No.: US 9,955,796 B2
(45) Date of Patent: May 1, 2018

(54) MATTRESS PROTECTOR AND REMOVABLE COVER ASSEMBLY

(71) Applicant: Fredman Brothers Furniture Company, Inc., St. Louis, MO (US)

(72) Inventors: John Schulte, Lake St. Louis, MO (US); Dan Baker, St. Louis, MO (US)

(73) Assignee: FREDMAN BROS. FURNITURE COMPANY, INC., St. Louis, MO (US)

( * ) Notice: Subject to any disclaimer, the term of this patent is extended or adjusted under 35 U.S.C. 154(b) by 0 days. days.

(21) Appl. No.: 15/220,683

(22) Filed: Jul. 27, 2016

(65) Prior Publication Data

US 2018/0027986 A1 Feb. 1, 2018

(51) Int. Cl.

| | |
|---|---|
| ***A47C 31/10*** | (2006.01) |
| ***A47C 27/00*** | (2006.01) |
| ***A47C 27/14*** | (2006.01) |
| ***A47C 27/08*** | (2006.01) |
| ***A47C 23/00*** | (2006.01) |

(52) U.S. Cl.

CPC ..... *A47C 31/105* (2013.01); *A47C 25/00* (2013.01); *A47C 27/001* (2013.01); *A47C 27/008* (2013.01); *A47C 27/081* (2013.01); *A47C 27/085* (2013.01); *A47C 27/14* (2013.01)

(58) Field of Classification Search

CPC ..... A47G 9/00; A47G 2009/001; A47G 9/02; A47G 9/0207; A47G 9/0223; A47G 9/0238; A47G 9/0246; A47G 9/04; A47C 31/00; A47C 31/10; A47C 31/105; A47C 27/002; A47C 27/005; A47C 27/006; A47C 27/007; A47C 27/008

USPC ... 5/500, 482, 484, 486, 496, 497, 499, 502, 5/690, 691, 699, 737, 738, 939

See application file for complete search history.

(56) References Cited

U.S. PATENT DOCUMENTS

| | | | | | |
|---|---|---|---|---|---|
| 2,400,731 | A * | 5/1946 | Armstrong | A47C 27/006 | 150/154 |
| 2,440,891 | A * | 5/1948 | Bockhold | A47C 31/105 | 190/903 |
| 2,879,524 | A * | 3/1959 | Eisen | A47C 27/05 | 5/484 |
| 3,083,378 | A * | 4/1963 | Pursell | A47C 21/022 | 5/413 R |
| 3,530,487 | A * | 9/1970 | Beer | A47G 9/02 | 5/494 |
| 3,570,026 | A * | 3/1971 | Allison | A47G 9/0238 | 5/486 |
| 3,832,743 | A * | 9/1974 | Smith | A47G 9/02 | 5/496 |
| 3,857,124 | A * | 12/1974 | Hadley | A47G 9/02 | 5/496 |
| 4,809,375 | A * | 3/1989 | Bull | A47C 21/048 | 5/722 |
| 5,666,680 | A * | 9/1997 | Hackett, Jr. | A47G 9/0246 | 5/496 |

(Continued)

*Primary Examiner* — Robert G Santos
(74) *Attorney, Agent, or Firm* — David H. Chervitz

(57) ABSTRACT

A mattress protector and removable cover assembly has a mattress protector for covering a mattress, the mattress protector having an exterior surface having a first zipper portion and a removable cover having a second zipper portion with the second zipper portion for mating with the first zipper portion for the removable cover for attaching to the mattress protector.

13 Claims, 6 Drawing Sheets

(56) References Cited

U.S. PATENT DOCUMENTS 6,098,219 A * 8/2000 Milber ..... A47C 21/022 5/494
6,163,907 A 12/2000 Larson
6,381,778 B1 * 5/2002 Peterson ..... A47C 27/005 5/484
6,490,741 B1 * 12/2002 Wheeler ..... A47G 9/02 5/494
6,631,529 B1 * 10/2003 Erickson ..... A47G 9/0246 5/484
7,003,832 B2 * 2/2006 Wilson ..... A47C 21/048 219/217
7,047,580 B2 * 5/2006 Finn ..... A47C 31/105 5/484
7,370,380 B2 * 5/2008 DeFranks ..... A47C 27/00 5/483
7,487,560 B2 * 2/2009 McGrath ..... A47C 21/022 5/484
7,587,775 B2 * 9/2009 DeFranks ..... A47C 27/00 5/483
7,617,556 B2 * 11/2009 Rensink ..... A47C 27/05 5/691
8,181,293 B2 * 5/2012 DeFranks ..... A47C 27/00 5/483
9,204,742 B2 * 12/2015 Jensen ..... A47G 9/0238
9,380,882 B2 * 7/2016 Murphy ..... A47C 27/056
9,538,855 B2 * 1/2017 Gross ..... A47C 27/15
9,601,034 B2 * 3/2017 Jensen ..... G09F 3/00
9,675,189 B2 * 6/2017 Jensen ..... A47G 9/04
2004/0128764 A1 * 7/2004 McGrath ..... A47C 21/022 5/499
2005/0177942 A1 * 8/2005 Finn ..... A47C 31/105 5/499
2006/0000023 A1 * 1/2006 Wilson ..... A47C 21/048 5/655
2006/0010608 A1 * 1/2006 DeFranks ..... A47C 27/00 5/738
2006/0059631 A1 * 3/2006 Rensink ..... A47C 31/02 5/739
2008/0005845 A1 1/2008 Moran Pfleger
2008/0172796 A1 * 7/2008 Defranks ..... A47C 27/00 5/698
2009/0293195 A1 * 12/2009 McGrath ..... A47C 21/022 5/484
2010/0000019 A1 * 1/2010 DeFranks ..... A47C 27/00 5/691
2014/0075678 A1 * 3/2014 Murphy ..... A47C 27/056 5/698
2014/0208517 A1 * 7/2014 Gross ..... A47C 27/15 5/691
2015/0182031 A1 * 7/2015 Jensen ..... A47G 9/0238 5/690
2015/0182032 A1 * 7/2015 Jensen ..... G09F 3/00 5/699
2015/0182042 A1 * 7/2015 Jensen ..... A47G 9/04 5/636
2015/0187233 A1 * 7/2015 Jensen ..... G09F 3/02 427/256
2016/0128499 A1 5/2016 Jhou
2017/0238717 A1 * 8/2017 Jensen ..... A47C 27/001
2018/0027986 A1 * 2/2018 Schulte ..... A47C 31/105

* cited by examiner

MATTRESS PROTECTOR AND REMOVABLE COVER ASSEMBLY

BACKGROUND OF THE DISCLOSURE

This disclosure relates to a mattresses protector and more particularly to a mattress protector and removable cover assembly.

Conventional beds may consist of a mattress, a box spring, a headboard, a foot board, and a bed frame for supporting the mattress and the box spring. The mattress can take on various forms and constructions such as springs, foam, memory foam, air, or water. For example, a standard mattress includes a plurality of metal springs or coils sandwiched between a pair of pads. A cloth cover is used to encase the springs and pads. Over time the mattress may be turned over when one side becomes worn out or depressed due to wear and use. Other than repair or replacement there is no other way to adjust the mattress. A foam mattress may include one or more layers of foam assembled encased within a fabric cover to resemble a standard spring mattress. Again, other than reversing the foam mattress or removing or replacing the foam layers there is no other way to adjust the foam mattress. Memory foam is made from polyurethane and is often referred to as visco-elastic polyurethane foam. Memory foam is firmer in cool temperatures and softer when warm. Higher density memory foam reacts to body heat that allows it to mold itself to the shape of warm body within a few minutes. Lower density memory foam is pressure sensitive and will mold more quickly to the shape of the body. Memory foam is heavier than a foam mattress and more expensive. Also, memory foam mattresses do not provide any ability to adjust various portions of the mattress. An air mattress typically contains one or more air chambers that are filled with air. Some known air mattresses have two chambers on each side of the bed and allow a user to adjust each side to various degrees of firmness. However, the adjustment is limited to the entire length of the air mattress and no provision is available for adjusting various areas under a body. A waterbed may consist of one or more bladders or chambers filled with water. However, once filled the bed is either not adjustable or very difficult to adjust.

Mattresses may be an expensive item. In view of this, it is important to protect the mattress from becoming soiled, stained, dirty, or worn. Typically, a bed sheet is the only device used for protecting a mattress from being damaged. However, a bed sheet offers very little protection to the mattress. Some mattress protectors have been available for protecting mattresses. For example, a mattress protector may consist of a polyurethane or other plastic membrane laminated to the back of a fabric such as a polyester, cotton, or blended material with the mattress protector fitting over the mattress. Additionally, the mattress protector must be removed from the mattress to be cleaned or washed once the mattress protector becomes soiled or dirty. Removing the mattress protector may require lifting up the mattress partially or entirely. Since some mattresses are very heavy this may be a difficult task. Although such mattress protectors add some level of protection, the mattress protectors tend to be uncomfortable to sleep on because the mattress protectors do not absorb sweat or perspiration. Further, once a mattress protector is installed on a mattress, the mattress may lose its feel and structure. For example, some mattresses have a pillow top and a mattress protector may negate the pillow top feel and comfort.

The present mattress protector and removable cover assembly is designed to obviate and overcome many of the disadvantages and shortcomings associated with prior mattresses protectors. Further, the present mattress protector and removable cover assembly provides a removable cover assembly that may be easily changed or cleaned. Moreover, the present mattress protector and removable cover assembly provides a removable cover that can provide the same feel and comfort as the mattress upon which the removable cover is placed. The mattress protector and removable cover assembly is applicable for use with any sized mattress or bed such as twin, twin-extra long, full, queen, kings, and California king size beds.

SUMMARY OF THE DISCLOSURE

In one form of the present disclosure, a mattress protector and removable cover assembly is disclosed which comprises a mattress protector for covering a mattress, the mattress protector having an exterior surface having a first zipper portion and a removable cover having a second zipper portion with the second zipper portion for mating with the first zipper portion for the removable cover for attaching to the mattress protector.

In another form of the present disclosure, a mattress protector and removable cover assembly comprises a mattress protector for covering a mattress, the mattress protector having an exterior surface having a first zipper portion and a cover portion for covering the first zipper portion, and a removable cover having a second zipper portion with the second zipper portion for mating with the first zipper portion for the removable cover for attaching to the mattress protector.

In yet another form of the present disclosure, a mattress protector and removable cover assembly is disclosed which comprises a mattress protector for covering a mattress, the mattress protector having an exterior surface having a first zipper portion, and a cover assembly having a second zipper portion with the second zipper portion for mating with the first zipper portion for the removable cover for attaching to the mattress protector, a first layer, and second layer, a pocket formed between the first layer and the second layer, and a mattress element in the pocket.

In light of the foregoing comments, it will be recognized that the present disclosure provides a mattress protector and removable cover assembly that is of simple construction and design and which can be easily employed with highly reliable results.

The present disclosure also provides a mattress protector and removable cover assembly that employs lightweight structures or components.

The present disclosure further provides a mattress protector and removable cover assembly that can be shipped in a compact form and container.

The present disclosure is also directed to a mattress protector and removable cover assembly that may provide various cover assemblies to provide various different mattress types for a user.

The present disclosure provides a mattress protector and removable cover assembly that covers a mattress and is difficult to remove from the mattress to prevent theft of the mattress protector.

The present disclosure is directed to a mattress protector and removable cover assembly that is easy to separate the removable cover from the mattress protector to clean the removable cover.

These and other objects and advantages of the present disclosure will become apparent after considering the following detailed specification in conjunction with the accompanying drawings, wherein

DETAILED DESCRIPTION OF THE EMBODIMENTS

Figure 1:
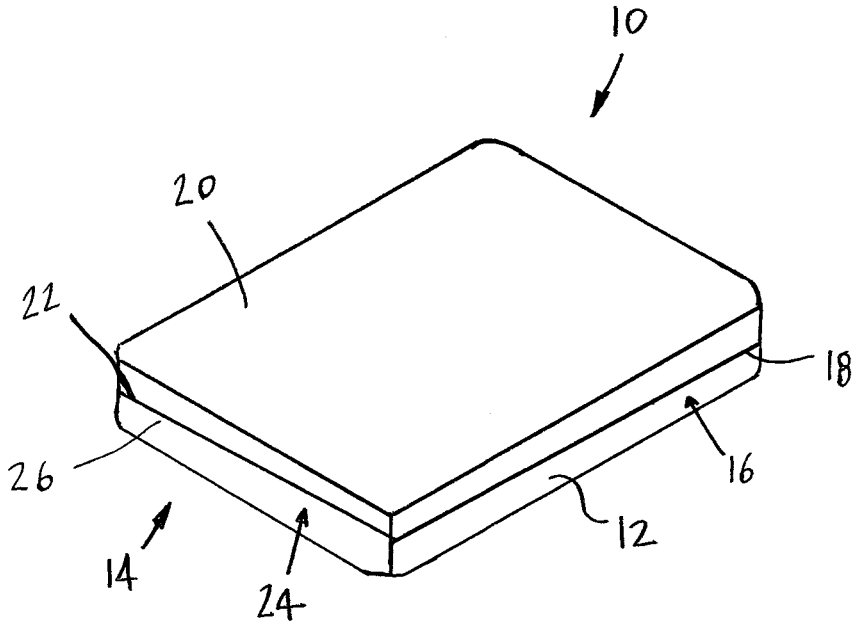
FIG. 1 is a perspective view of a mattress protector and removable cover assembly constructed according to the present disclosure.

Referring now to the drawings, wherein like numbers refer to like items, number 10 identifies an embodiment of a mattress protector and removable cover assembly constructed according to the present disclosure. With reference now to FIG. 1, the mattress protector and removable cover assembly 10 is shown comprising a mattress cover or protector 12 for covering a mattress 14, the mattress protector 12 has an exterior surface 16 having a first zipper portion 18. A removable cover 20 has a second zipper portion 22 with the second zipper portion 22 for mating or meshing with the first zipper portion 18 for the removable cover 20 for covering a portion 24 of the mattress protector 12. As can be appreciated, the first zipper portion 18 may extend along the entire perimeter of the mattress 14 or the mattress protector 12 and the second zipper portion 22 may extend along the entire perimeter of the removable cover 20. It is also possible that the first zipper portion 18 and the second zipper portion 22 may extend along only a portion of the perimeter of the mattress 14. Further, although the first zipper portion 18 is shown being halfway up a side 26 of the mattress 14, it is also contemplated that the first zipper portion 18 may be at any position on the side 26 of the mattress 14. In this particular situation, the removable cover 20 is sized and shaped so that the second zipper portion 22 will be able to mate with the first zipper portion 18 wherever the first zipper portion 18 is positioned. By use of the first zipper portion 18 and the second zipper portion 22, the removable cover 20 may be attached to or removed from the mattress cover 12. As will be discussed further herein, different types of removable covers 20 may be attached to the mattress cover 12 as need be. Further, the removable cover 20 may be easily removed from the mattress cover 12 for cleaning or replacement.

Figure 2:
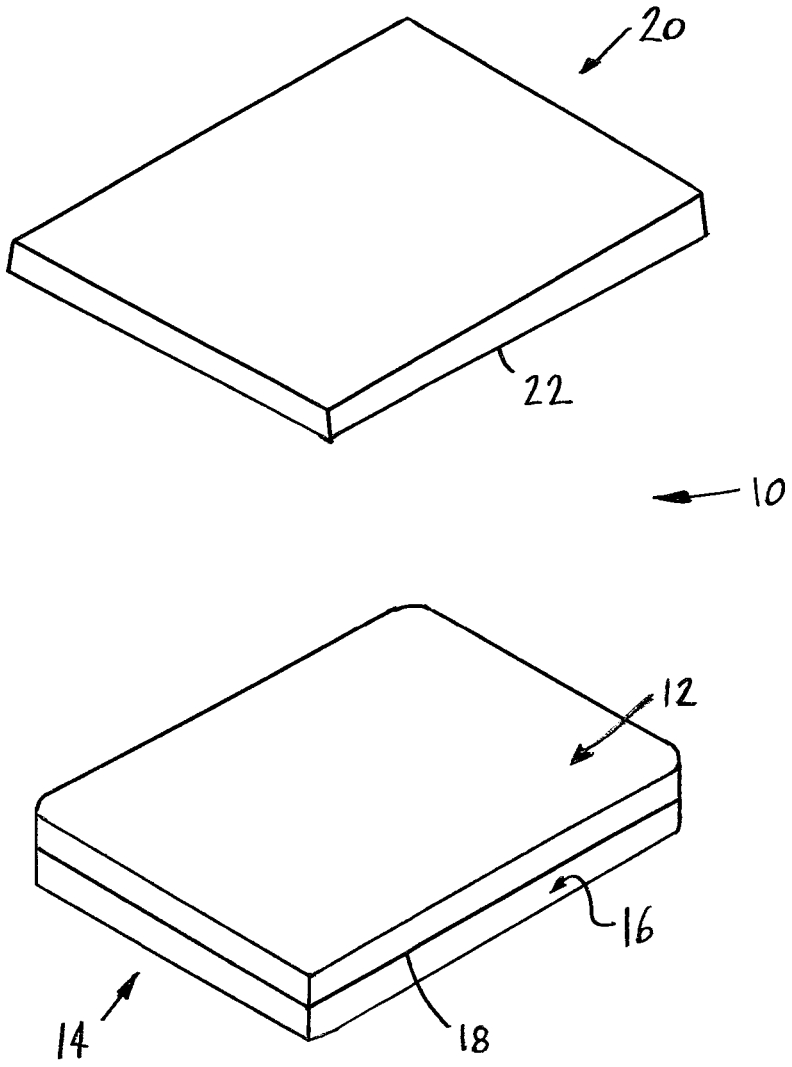
FIG. 2 is a perspective view of the mattress protector and removable cover assembly shown in FIG. 1 with the removable cover separated from the mattress protector.

FIG. 2 shows the removable cover 20 being detached or removed from the mattress protector 12. The assembly 10 is shown comprising the mattress protector 12 for covering the mattress 14. The mattress protector 12 has the exterior surface 16 having the first zipper portion 18. The cover assembly 20 has the second zipper portion 22 with the second zipper portion 22 for meshing with the first zipper portion 18 for connecting the removable cover 20 to the mattress protector 12 to form the assembly 10. The cover assembly 20 may be constructed of any suitable material. For example, the cover assembly 20 may be made of a cooling, phase changing, or wicking material for use in the summer months or the cover assembly 20 may be made of a terry cloth, a cotton fabric, a polyester fabric, a blended blended, or a wool fabric for use in the winter months.

Figure 3:
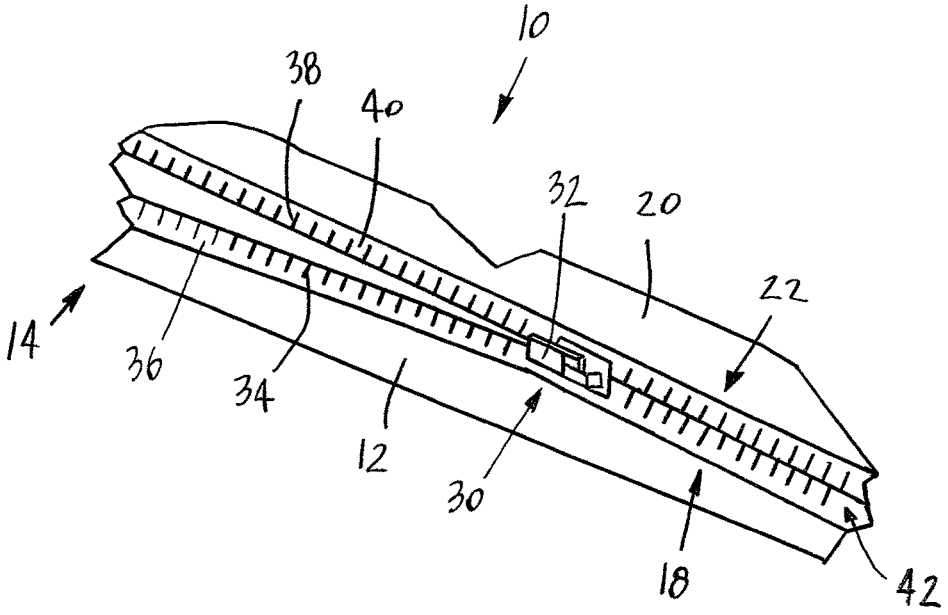
FIG. 3 is a partial view of a first zipper portion and a second zipper portion of the mattress protector and removable cover assembly constructed according to the present disclosure.

With reference now to FIG. 3, a partial view of the first zipper portion 18 and the second zipper portion 22 of the assembly 10 is illustrated. The first zipper portion 18 has a slider member 30 having a pull tab 32 inserted thereon. The first zipper portion 18 also has a plurality of teeth 34 positioned along a first tape portion 36. The second zipper portion 22 has a plurality of teeth 38 positioned along a second tape portion 40. When the slider member 30 is used to mesh the teeth 34 and 38 together, a chain 42 is formed and the removable cover 20 is secured to the mattress protector 12. As has been previously indicated, the first zipper portion 18 may extend along the entire perimeter of the mattress 14 and the second zipper portion 22 may also extend along the entire perimeter of the mattress 14. It is also possible that the first zipper portion 18 and the second zipper portion 22 may extend along only a portion of the perimeter of the mattress 14. As can be appreciated, the pull tab 32 is grasped by a user of the assembly 10 to maneuver the slide member 30 to engage or disengage the teeth 34 and 38. In this manner, the removable cover 20 may be attached or removed from the mattress protector 12.

Figure 4:
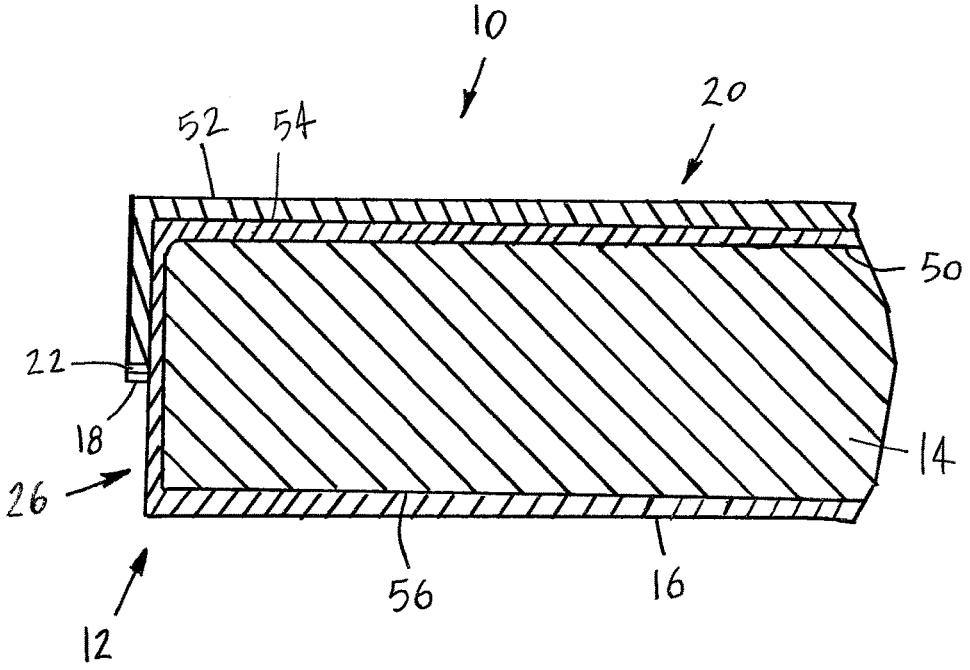
FIG. 4 is a partial cross-sectional view of the mattress protector and removable cover assembly constructed according to the present disclosure.

FIG. 4 depicts a partial cross-sectional view of the mattress protector and removable cover assembly 10 constructed according to the present disclosure. The mattress protector 12 has been placed over the mattress 14 to fully enclose the mattress 14 by the mattress protector 12. The removable cover 20 is shown being attached to the mattress protector 12 by use of the first zipper portion 18 and the second zipper portion 22. The first zipper portion 18 is connected to or sewn on the exterior surface 16 of the side 26 of the mattress protector 12. The mattress protector 12 also has an interior surface 50 that surrounds the mattress 14. The mattress protector 12 may be constructed of any suitable material and may be waterproof to protect the mattress 14. The removable cover 20 has an exterior surface 52 and an interior surface 54. The interior surface 54 is positioned over the exterior surface 16 of the mattress protector 12. The second zipper portion 22 is connected to or sewn on the removable cover 20. As will be explained further herein, the removable cover 20 may be constructed of any suitable material and may even be constructed to imitate the construction of the mattress 14. As has been previously indicated, the first zipper portion 18 may extend along the entire perimeter of the mattress 14 or the mattress protector 12 and the second zipper portion 22 may also extend along the entire perimeter of the removable cover 20. It is also possible that the first zipper portion 18 and the second zipper portion 22 may extend along only a portion of the perimeter of the mattress 14. Further, although the first zipper portion 18 is shown being halfway up the side 26 of the mattress protector 12, it is also contemplated that the first zipper portion 18 may be at any position on the mattress protector 12. For example, the first zipper portion 18 may be placed on a bottom position 56 of the mattress protector 12. In this particular arrangement the first zipper portion 18 and the second zipper portion 22 will be out of the way or view of a user of the assembly 10. Placement along the bottom position 56 may also prevent theft or unwanted removal of the assembly 10, the mattress protector 12, or the removable cover 20 when the assembly 10 is used in a hotel environment.

Figure 5:
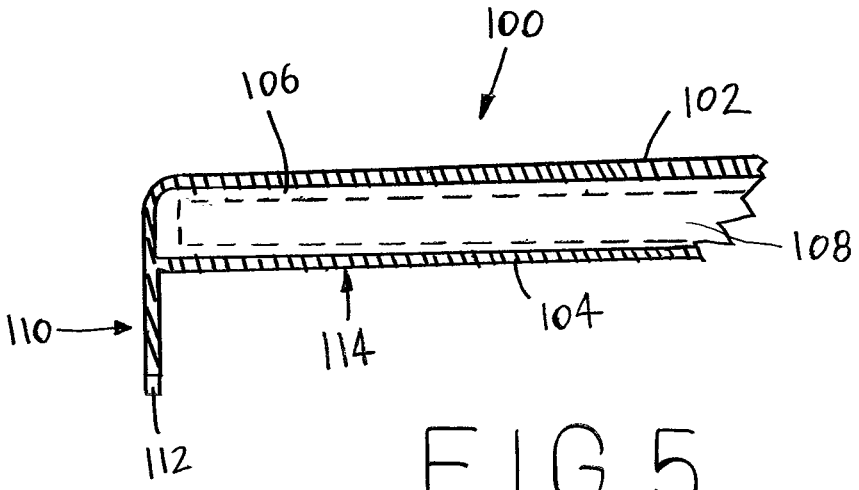
FIG. 5 is a partial cross-sectional view of an embodiment of a removable cover of the mattress protector and removable cover assembly constructed according to the present disclosure.

Referring now to FIG. 5, a partial cross-sectional view is shown of another embodiment of a removable cover 100 that may be used with the mattress protector 12 instead of the removable cover 20 of the mattress protector and removable cover assembly 10. The removable cover 100 has an upper layer or sheet 102, a lower layer or sheet 104, and a pocket 106 formed between the layers 102 and 104. A mattress element 108 may be placed inside of the pocket 106. The upper layer 102 also has a side 110 that has a second zipper portion 112 attached, connected, or sewn thereto. The second zipper portion 112 is used to mesh with the first zipper portion 18 (FIG. 3) of the mattress protector 12 (FIG. 3) to form the assembly 10 (FIG. 3). The side 110 is sized and shaped to be able to have the second zipper portion 112 mesh with the first zipper portion 18 of the mattress protector 12. The mattress element 108 may be a layer of foam, latex, memory foam, an air chamber or chambers, a water chamber or chambers, or metal springs and coils. In essence, the mattress element 108 is used to imitate the mattress 14 (FIG. 3) upon which the removable cover 100 is placed or provide a different mattress type than the mattress 14 upon which the removable cover 100 is placed. Other interior constructions for the mattress element 108 are possible such as feathers, down, and synthetic material. Although not shown, it is possible that the removable cover 100 may have an opening through which the mattress element 108 may be removed or inserted. For example, when cleaning the removable cover 100 it may be required or desired to remove the mattress element 108 from the pocket 106. Once the removable cover 100 has been cleaned, the mattress element 108 may be reinserted into the pocket 106. It is also contemplated that a user of the removable cover 100 may want to change the mattress element 108 to a different mattress element 108 to try a different feel. Further, although not shown, the lower layer 104 may have a non-skid surface on a bottom surface 114 of the lower layer 104. The layers 102 and 104 may be constructed of any suitable material.

Figure 6:
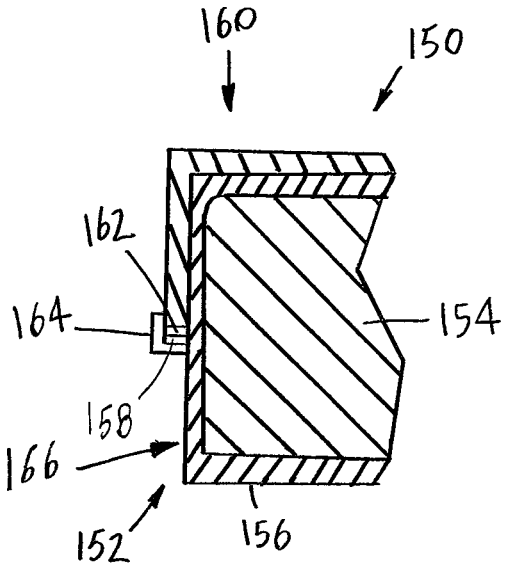
FIG. 6 is a partial cross-sectional view of another embodiment of a mattress protector and removable cover assembly constructed according to the present disclosure.

FIG. 6 illustrates a partial cross-sectional view of another embodiment of a mattress protector and removable cover assembly 150. The assembly 150 comprises a mattress cover or protector 152 for covering a mattress 154, the mattress protector 152 has an exterior surface 156 having a first zipper portion 158. A removable cover 160 has a second zipper portion 162 with the second zipper portion 162 for mating or meshing with the first zipper portion 158 of the removable cover 160 to attach the removable cover 160 to the mattress protector 152. The mattress protector 152 also has a cover portion 164 that is used to cover or conceal the zipper portions 158 and 162. As can be appreciated, the first zipper portion 158 may extend along the entire perimeter of the mattress 154 or the mattress protector 152 and the second zipper portion 162 may extend along the entire perimeter of the removable cover 160. It is also possible that the first zipper portion 158 and the second zipper portion 162 may extend along only a portion of the perimeter of the mattress 154. Further, although the first zipper portion 158 is shown being halfway up a side 166 of the mattress 154, it is also contemplated that the first zipper portion 158 may be at any position on the side 166 of the mattress 154. In this particular situation, the removable cover 160 is sized and shaped so that the second zipper portion 162 will be able to mate with the first zipper portion 158 wherever the first zipper portion 158 is positioned. By use of the first zipper portion 158 and the second zipper portion 162, the removable cover 160 may be attached to or removed from the mattress protector 152. As has been pointed out above, different types of removable covers 160 may be attached to the mattress protector 152 as need be. Further, the removable cover 160 may be easily removed from the mattress protector 152 for cleaning or replacement.

Figure 7:
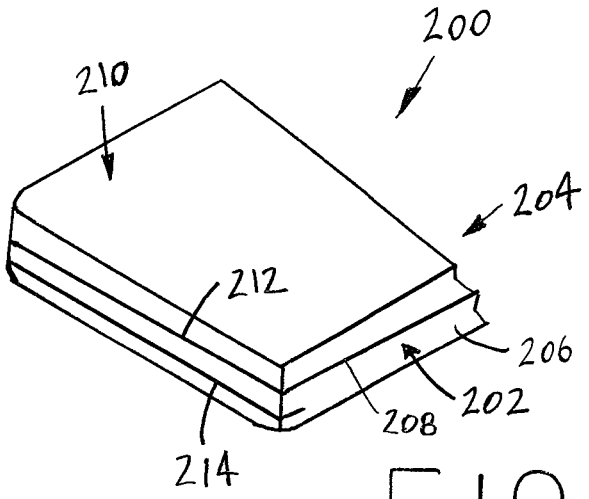
FIG. 7 is a partial view of another embodiment of a mattress protector and removable cover assembly constructed according to the present disclosure.

Referring now in particular to FIG. 7, a partial view of another embodiment of a mattress protector and removable cover assembly 200 constructed according to the present disclosure is shown. The mattress protector and removable cover assembly 200 comprises a mattress protector 202 for covering a mattress 204, the mattress protector 202 has an exterior surface 206 having a first zipper portion 208. A removable cover 210 has a second zipper portion 212 with the second zipper portion 212 for mating or meshing with the first zipper portion 208 of the removable cover 210 to attach the removable cover 210 to the mattress protector 202. The mattress protector 202 also has a zipper 214 for providing an opening in through which the mattress 204 is inserted for the mattress protector 202 to encase the mattress 204. Although not shown, the mattress protector 202 may having a cover portion for covering the zipper 214. It is preferable that once the mattress protector 202 is installed over the mattress 204 that the mattress protector 202 is not removed from the mattress 204 and only the removable cover 210 is removed for cleaning, changing, or replacing.

Figure 8:
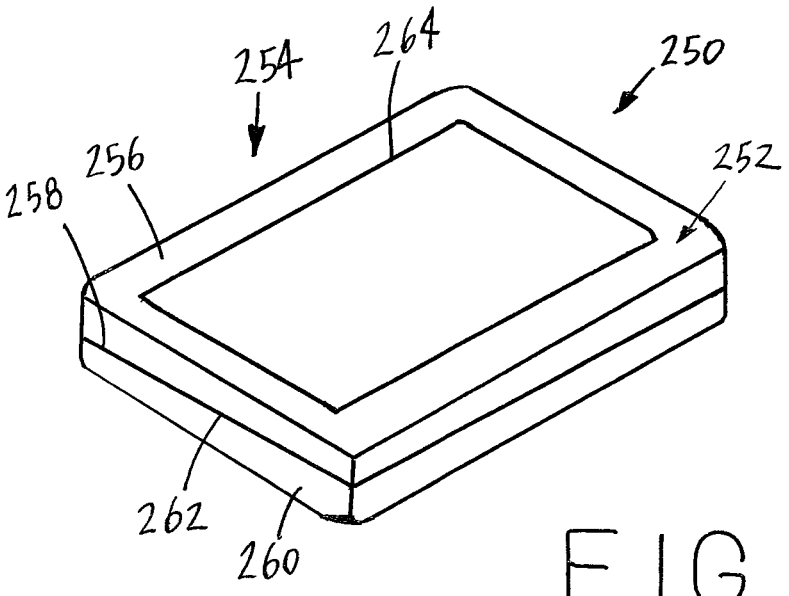
FIG. 8 is a perspective view of another embodiment of a mattress protector and removable cover assembly constructed according to the present disclosure.

FIG. 8 depicts a perspective view of another embodiment of a mattress protector and removable cover assembly 250. The mattress protector and removable cover assembly 250 comprises a mattress cover or protector 252 for covering a mattress 254, the mattress protector 252 has an exterior surface 256 having a first zipper portion 258. A removable cover 260 has a second zipper portion 262 with the second zipper portion 262 for mating or meshing with the first zipper portion 258 of the removable cover 260 to attach the removable cover 260 to the mattress protector 252. As should be realized, this particular view is a bottom view of the assembly 250 installed on the mattress 254. The mattress protector 252 also has a zipper 264 for providing an opening in through which the mattress 254 is inserted for the mattress protector 252 to encase the mattress 254. Although the zipper 264 is shown as extending around the mattress protector 252, it should be noted that the zipper 264 may extend around only a portion of the mattress protector 252. It is preferred that once the mattress protector 252 is installed over the mattress 254 that the mattress protector 252 is not removed from the mattress 254 and only the removable cover 260 is removed for cleaning, changing, or replacing. The assembly 250 is well suited for applications, such as a hotel setting, in which it should be made difficult to remove the mattress protector 252 from the mattress 254. This helps prevents theft or unwanted removal of the assembly 250 or the mattress protector 252.

As can be realized, the mattress protector and removable cover assemblies 10, 150, 200, and 250 are applicable for use with twin, twin-extra long, full, queen, kings and California king size beds. The assemblies 10, 150, 200, and 250 may be sized and shaped to be placed on or over any existing mattresses. Also, the mattress protector and removable cover assemblies 10, 150, 200, and 250 may be used with a foundation that is placed on a metal bed frame for supporting the mattress, the foundation, and the assemblies 10, 150, 200, and 250 above the floor. The assemblies 10, 150, 200, and 250 may be packaged in portions or sections so that the assembly 10 may be easily stored, inventoried, or transported.

From all that has been said, it will be clear that there has thus been shown and described herein a mattress protector and removable cover assembly which fulfills the various objects and advantages sought therefore. It will become apparent to those skilled in the art, however, that many changes, modifications, variations, and other uses and applications of the subject mattress protector and removable cover assembly are possible and contemplated. All changes, modifications, variations, and other uses and applications which do not depart from the spirit and scope of the are deemed to be covered by the subject mattress protector and removable cover assembly, which is limited only by the claims which follow.

What is claimed is:

1. A mattress protector and removable cover assembly comprising:

a mattress protector for fully enclosing a mattress having a perimeter, the mattress protector having an exterior surface having a first zipper portion and a cover portion for covering the first zipper portion, the first zipper portion and the cover portion extending along the entire perimeter of the mattress, the cover portion connected to the mattress protector and extending outwardly and upwardly from the mattress protector for covering the first zipper portion; and a removable cover having a second zipper portion with the second zipper portion for mating with the first zipper portion for the removable cover for attaching to the mattress protector, the second zipper portion extending along the entire perimeter of the mattress, the cover portion for covering the second zipper portion and a portion of the mattress protector when the second zipper portion is mated to the first zipper portion with the cover portion concealing the first zipper portion and the second zipper portion, and the height of the cover portion is substantially less than the height of the removable cover.

2. The mattress protector and removable cover assembly of claim 1 wherein the mattress protector further comprises a zipper for providing an opening.

3. The mattress protector and removable cover assembly of claim 2 wherein the mattress protector has a bottom and the zipper is positioned on the bottom.

4. The mattress protector and removable cover assembly of claim 2 wherein the mattress protector has a side and the zipper is positioned on the side.

5. The mattress protector and removable cover assembly of claim 1 wherein the removable cover comprises a wool fabric.

6. The mattress protector and removable cover assembly of claim 1 wherein the removable cover comprises a terry cloth material.

7. The mattress protector and removable cover assembly of claim 1 wherein the removable cover comprises a wicking material.

8. A mattress protector and removable cover assembly comprising:

a mattress protector for fully enclosing a mattress, the mattress protector having an exterior surface having a first zipper portion and a cover portion for covering the first zipper portion, the cover portion connected to the mattress protector and extending outwardly and upwardly from the mattress protector for covering the first zipper portion; and a removable cover having a second zipper portion with the second zipper portion for mating with the first zipper portion for the removable cover for attaching to the mattress protector, a first layer, a second layer, a pocket formed between the first layer and the second layer, and a mattress element in the pocket, the cover portion for covering the second zipper portion and a portion of the mattress protector when the second zipper portion is mated to the first zipper portion with the cover portion concealing the first zipper portion and the second zipper portion, and the height of the cover portion is substantially less than the height of the removable cover.

9. The mattress protector and removable cover assembly of claim 8 wherein the mattress element comprises a layer of foam material.

10. The mattress protector and removable cover assembly of claim 8 wherein the mattress element comprises an air chamber.

11. The mattress protector and removable cover assembly of claim 8 wherein the mattress element comprises a water chamber.

12. The mattress protector and removable cover assembly of claim 8 wherein the mattress element comprises springs and coils.

13. The mattress protector and removable cover assembly of claim 8 wherein the mattress element comprises a synthetic material.

* * * * *